US006505769B2

(12) United States Patent
Stone

(10) Patent No.: US 6,505,769 B2
(45) Date of Patent: Jan. 14, 2003

(54) PARTIAL WEB IN TRAY CORNERS

(75) Inventor: James L. Stone, Grand Rapids, MI (US)

(73) Assignee: Caraustar Custom Packaging, Grand Rapids, MI (US)

( * ) Notice: Subject to any disclaimer, the term of this patent is extended or adjusted under 35 U.S.C. 154(b) by 86 days.

(21) Appl. No.: 09/838,496

(22) Filed: Apr. 19, 2001

(65) Prior Publication Data

US 2002/0153408 A1 Oct. 24, 2002

(51) Int. Cl.[7] ..... B65D 5/24

(52) U.S. Cl. ..... 229/186; 229/125.35; 229/941; 493/59; 493/63; 493/162

(58) Field of Search ..... 229/125.35, 133, 229/186, 187, 190, 941; 493/59, 61–63, 80, 162

(56) References Cited

U.S. PATENT DOCUMENTS

| | | | | | |
|---|---|---|---|---|---|
| 1,723,150 | A | * | 8/1929 | Gannon et al. | 229/133 |
| 2,485,235 | A | * | 10/1949 | Graf | 229/133 |
| 3,106,330 | A | | 10/1963 | Rausing | |
| 3,146,933 | A | * | 9/1964 | Moore | 229/186 |
| 3,182,887 | A | | 5/1965 | Larson | |
| 3,236,436 | A | | 2/1966 | Cheeley | |
| 3,734,391 | A | * | 5/1973 | Manizza | 229/187 |
| 4,866,232 | A | | 9/1989 | Stone | 219/10.55 |
| 4,915,292 | A | * | 4/1990 | Ielmini | 229/186 |
| 4,930,681 | A | | 6/1990 | Fultz et al. | 229/114 |
| 4,951,865 | A | | 8/1990 | Eisman | 229/146 |
| 5,244,145 | A | | 9/1993 | Forbes, Jr. | 229/125.35 |
| 5,855,317 | A | * | 1/1999 | Dalrymple | 229/186 |

* cited by examiner

*Primary Examiner*—Gary E. Elkins
(74) *Attorney, Agent, or Firm*—Jenkens & Gilchrist

(57) ABSTRACT

A tray composed of a unitary, continuous blank has an inner surface and an outer surface. The tray comprises a bottom wall, a plurality of sidewalls extending upwardly from the bottom wall and a plurality of minor flaps. Each of the plurality of minor flaps is connected to one of the sidewalls via a fold line and has a respective outer edge. At least one of the minor flaps is connected to a sidewall via a first cut score. The first cut score extends upwardly from the bottom wall without extending to an outer edge of the minor flap. The at least one minor flap is separated from the sidewall via a knife cut. The knife cut extends from near the outer edge of the minor flap downward toward and near the first cut score. The at least one minor flap has a second cut score formed therein. The second cut score extends from near the separation means. The first and second cut scores are formed from opposing surfaces of the blank so as to form a partial web.

40 Claims, 6 Drawing Sheets

PARTIAL WEB IN TRAY CORNERS

FIELD OF THE INVENTION

The present invention relates generally to trays and, more particularly, to a webbed tray that inhibits leaking of food and/or liquid products.

BACKGROUND OF THE INVENTION

Various types of trays have been used commercially to hold different types of food and/or liquid products. Typically, these trays are inexpensive because they are designed to be used once by the customer. One of the more common types of material used in forming these trays is paperboard.

One type of tray that is commonly used is a straight-walled tray with a web comer. One example of such a tray is shown in U.S. Pat. No. 5,244,145. This type of tray is generally referred to as a full-web comer tray. Full-web comer trays are typically formed by folding the sidewalls perpendicularly to a bottom wall and having the web comer folded on an outer surface of a sidewall. The outer surface of the web is glued to the outer surface of the sidewall. Portions of the inner surfaces of the web comer are folded upon each other such that each comer will have a thickness that is three times greater than the remainder of the sidewalls. These inner surfaces portions of the web comer may also be glued to each other. Full-web comer trays typically provide desired leak protection, but have several disadvantages. For example, full-web corner trays may be difficult to stack because of the varying thickness of the sidewalls and may also present glue compression issues. Also, the processing of full-web comer trays is less economical than other trays because of the complicated machinery involved in forming these trays. Another tray that is commonly used is referred to as a Brightwood tray. Examples of such trays include those shown in U.S. Pat. Nos. 4,930,681 and 4,951,865. The process of forming a Brightwood tray is often desirable because of its ease and simplicity. The Brightwood trays typically, however, do not have the desired leak protection as compared to typical full-web corner trays. It is, of course, desirable to prevent or inhibit leaks that may stain the apparel of consumers and/or cause damage to consumers (e.g., burns from hot liquid).

Accordingly, a need exists for a tray that overcomes the above-noted shortcoming associated with existing trays.

SUMMARY OF THE INVENTION

According to one embodiment of the present invention, a tray is composed of a unitary, continuous blank having an inner surface and an outer surface. The tray comprises a bottom wall, a plurality of sidewalls extending upwardly from the bottom is wall and a plurality of minor flaps. Each of the plurality of minor flaps is connected to one of the sidewalls via a fold line and has a respective outer edge. At least one of the minor flaps is connected to a sidewall via a first cut score. The first cut score extends upwardly from the bottom wall without extending to an outer edge of the minor flap. The at least one minor flap has means to separate from the sidewall. The separation means extends from near the outer edge of the minor flap downward toward and near the first cut score. The at least one minor flap has a second cut score formed therein. The second cut score extends from near the separation means. The first and second cut scores are formed from opposing surfaces of the blank so as to form a partial web. The separation means is preferably a knife cut.

According to another embodiment of the present invention, a unitary, continuous blank for forming a container has an inner surface and an outer surface. The blank comprises a bottom wall panel, a plurality of sidewall panels and a plurality of minor flaps. Each of the plurality of minor flaps is connected to one of the sidewall panels via a respective fold line and has a respective outer edge. At least one of the minor flaps is connected to a sidewall panel via a first cut score. The first cut score extends from the bottom wall panel without extending to an outer edge of the minor flap. The at least one minor flap has means to separate from the sidewall panel. The separation means extends from near the outer edge of the minor flap toward and near the first cut score. The at least one minor flap has a second cut score formed therein. The second cut score extends from near the separation means. The first and second cut scores are formed from opposing surfaces of the blank and adapted to form a partial web.

According to one process of the present invention, a container composed of a unitary, continuous blank is formed. The blank has an inner surface and an outer surface. The blank comprises a bottom wall panel, a plurality of sidewall panels and a plurality of minor flaps. Each of the plurality of sidewall panels is connected to the bottom wall panel via respective fold lines. Each of the plurality of minor flaps is connected to one of the sidewall panels via a fold line and has a respective outer edge. Each of the minor flaps is connected to a respective sidewall panel via a respective first cut score. Each of the first cut scores extends from the bottom wall panel without extending to an outer edge of the respective minor flaps. Each of the minor flaps has means to separate from the sidewall panels. Each of the separation means extends from near the outer edge of the minor flap toward and near the first cut score. Each of the minor flaps has a second cut score formed therein. Each of the second cut scores extends from near the respective separation means. Each of the first and second cut scores is formed from opposing surfaces of the blank and adapted to form a respective partial web. The plurality of sidewall panels are folded upwardly from the bottom wall panel via the respective fold lines. Each of the minor flaps are folded and secured to the respective sidewall panels that each of the minor flaps is connected thereto via the respective first cut scores such that the respective partial webs are formed from the respective first and second cut scores.

BRIEF DESCRIPTION OF THE DRAWINGS

Other objects and advantages of the invention will become apparent upon reading the following detailed description and upon reference to the drawings in which.

DETAILED DESCRIPTION OF THE ILLUSTRATED EMBODIMENT

Figure 1:
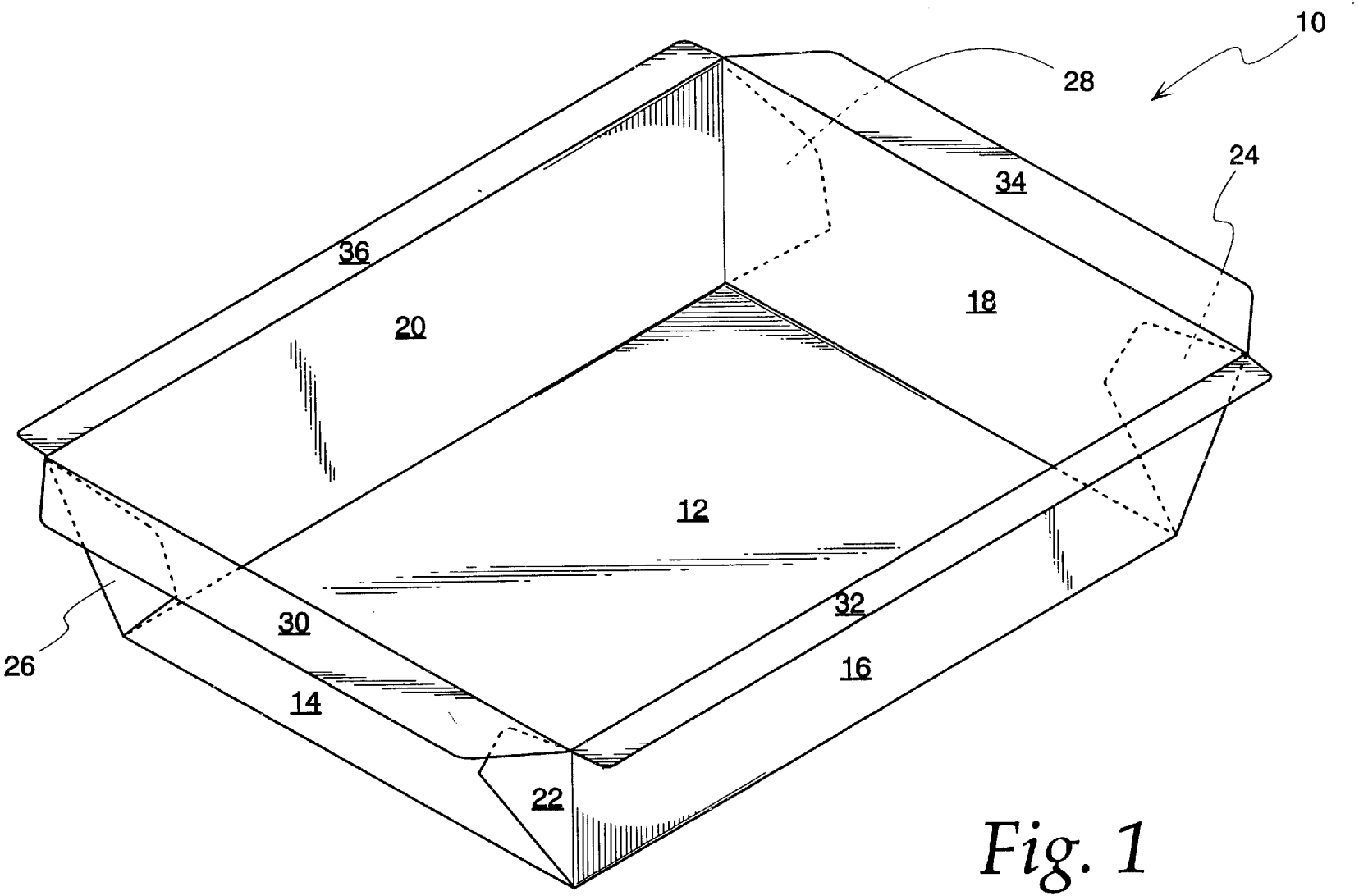
FIG. 1 is a perspective view of a tray according to one embodiment of the present invention.

Turning now to the drawings, FIG. 1 illustrates a tray 10 formed from a unitary, continuous blank according to one embodiment of the present invention. The tray 10 includes a bottom wall or panel 12 and four sidewalls or major panels 14, 16, 18 and 20 extending upwardly and slightly outwardly from the bottom wall 12. The sidewalls may also be referred to as sidewall panels. The tray 10 also includes four minor flaps 22, 24, 26, and 28 that are connected to the sidewalls. The tray 10 of FIG. 1 further includes optional flanges or horizontal edges 30, 32, 34, and 36 that extend outwardly from respective sidewalls 14, 16, 18 and 20. While the tray 10 is depicted in FIG. 1 as being of a generally rectangular configuration, the invention disclosed herein is not intended to be limited thereto, but may take various other geometric shapes, such as a square or other polygonal shapes.

Figure 2:
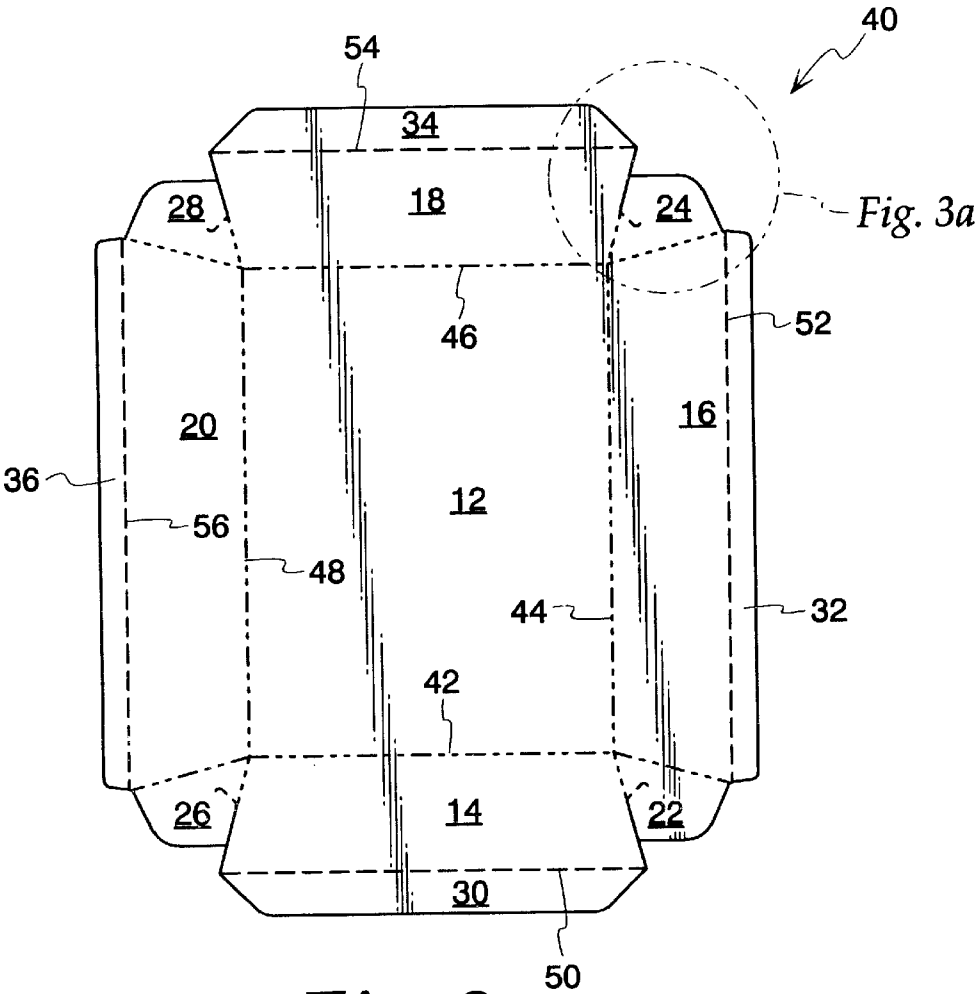
FIG. 2 is a plan view of an inner surface of a unitary, continuous blank used to form the tray of FIG. 1.

A unitary blank 40 for forming the tray 10 is shown in FIG. 2. Identical references are used in FIGS. 1 and 2, as well as the remaining figures, to indicate corresponding portions of the blank and the tray. The bottom wall 12 is integrally connected to the sidewalls 14, 16, 18 and 20 via respective fold lines 42, 44, 46 and 48. The optional flanges 30, 32, 34 and 36 are connected to respective sidewalls 14, 16, 18 and 20 via optional respective fold lines 50, 52, 54, and 56.

Figure 3B:
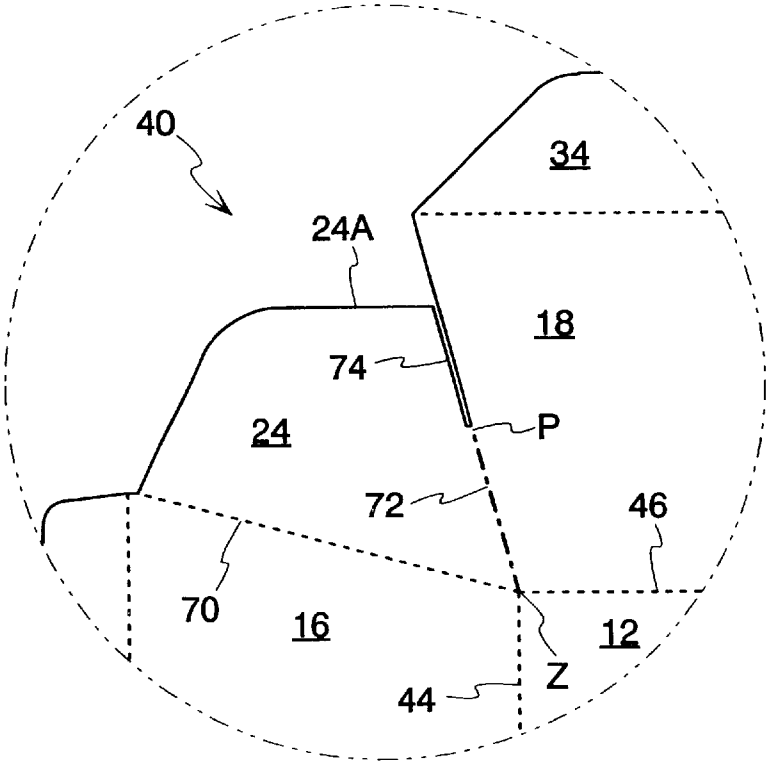
FIG. 3*b* is an enlarged plan view of FIG. 3*a* shown from an outer surface of the one minor flap.

A portion of the blank of FIG. 2 has been enlarged to better show the features in the general vicinity of the minor flap 24. Specifically, FIGS. 3*a* and *b* depict an enlarged portion of the minor flap 24 from an inner surface of the blank 40 (FIG. 3*a*) and from an outer surface of the blank 40 (FIG. 3*b*). The minor flap 24 of FIGS. 3*a* and *b* is representative of the remaining minor flaps 22, 26 and 28 of the blank 40. It is contemplated, however, that less than all of the minor flaps may have the features described below with respect to the minor flap 24. It is preferred, however, to have all of the features of the minor flap 24 incorporated in the minor flaps 22, 26 and 28.

Figure 3A:
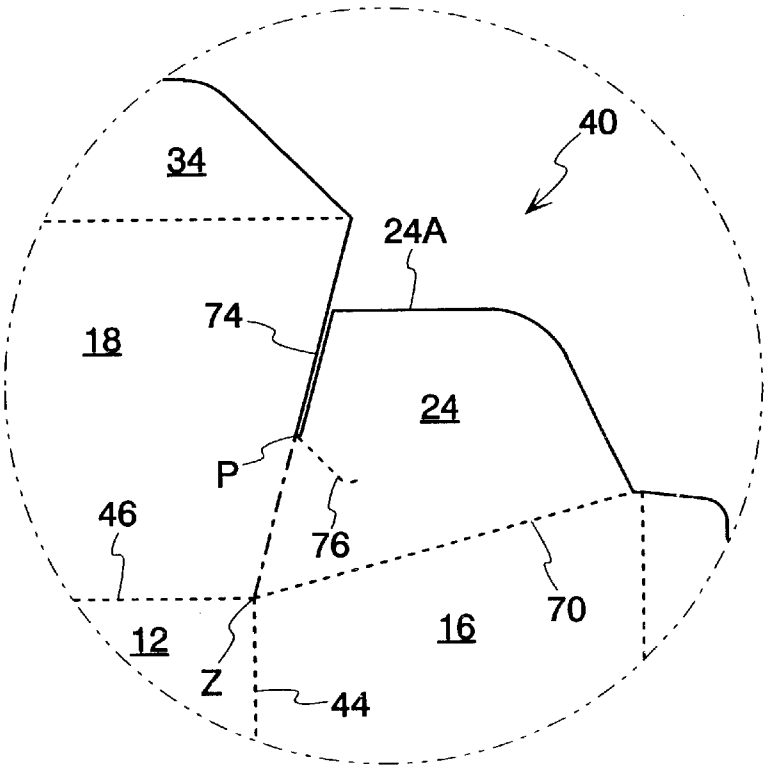
FIG. 3*a* is an enlarged plan view of one minor flap of the present invention shown in FIG. 2.

Referring still to FIGS. 3*a* and *b*, a portion of the blank 40 includes the minor flap 24, the sidewalls 16 and 18, and the bottom wall 12. The minor flap 24 and the sidewall 16 are integrally connected via a fold line 70. The minor flap 24 is connected to the sidewall 18 via a first cut score 72 (see FIG. 3*b*) that extends from the bottom wall 12 upwardly to or near intersection point P. More specifically, the first cut score 72 extends from the intersection of bottom wall 12, sidewalls 16 and 18 and the minor flap 24 at intersection point Z. The first cut score 72 is formed from the outer surface of the blank 40 and, thus, is hidden in FIG. 3*a*. The first cut score 72 may be referred to as an outside cut score. The first cut score 72 generally extends from about 30 to about 70% into the blank and, more typically, extends from about 40 to about 60% into the blank 40.

The minor flap 24 is separated from the sidewall 18 via a knife cut 74. The knife cut 74 extends 100% through the blank 40 and extends from near or at a top edge 24*a* of the minor flap 24 downwardly to or near the intersection point P. It is preferred that the knife cut 74 extends downwardly to and intersects the first cut score 72.

Figure 8B:
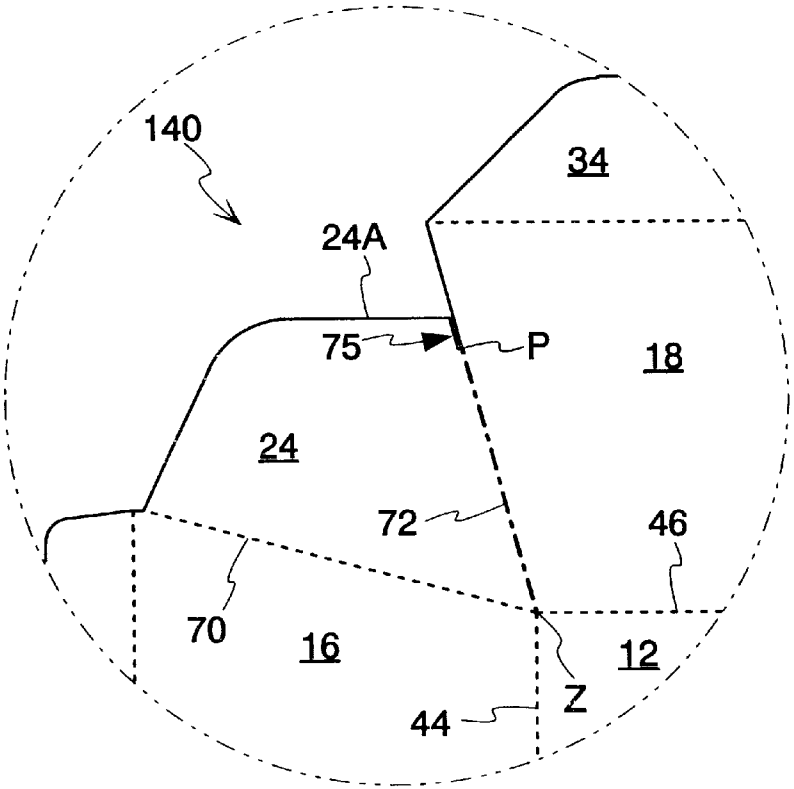
FIG. 8*b* is an enlarged plan view of FIG. 8*a* shown from an outer surface of the one minor flap.
Figure 8A:
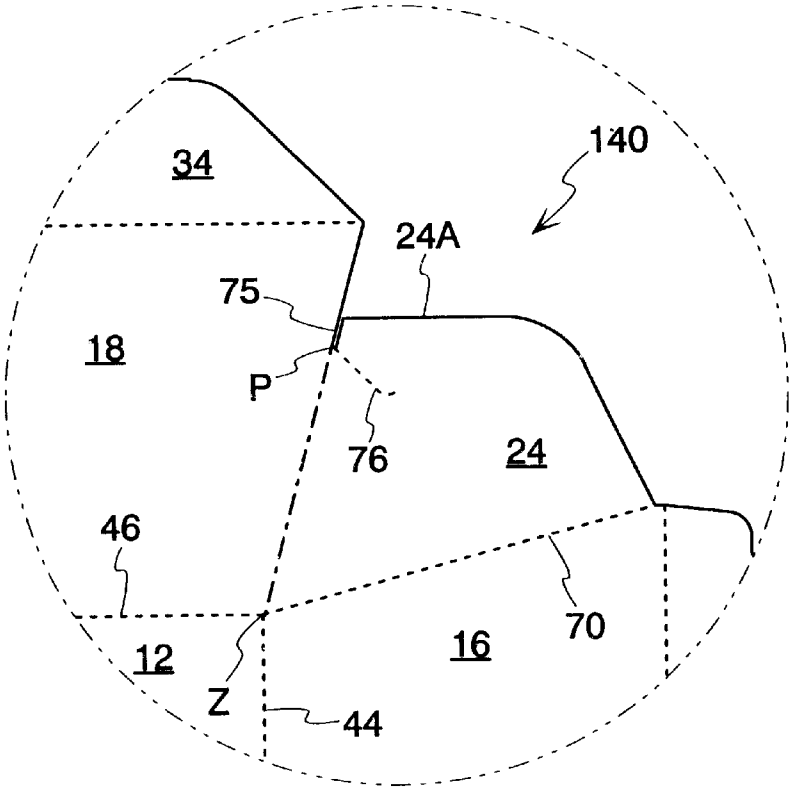
FIG. 8*a* is an enlarged plan view of one minor flap according to another embodiment.

It is contemplated that the minor flap 24 may be separated from the sidewall 18 via a nick 75 (See FIGS. 8*a*, 8*b*) near or at the top edge 24*a* of the minor flap 24 that extends downwardly toward the bottom wall 12. FIGS. 8*a* and 8*b* depict an enlarged portion of the minor flap 24 from an inner surface of a blank 140 (FIG. 8*a*) and from an outer surface of the blank 140 (FIG. 8*b*). Blank 140 is the same as blank 40, except for the nick 75 replacing the knife cut 74. In such an embodiment, the first cut score would likely extend further toward the top edge 24*a* than shown with respect to the first cut score 72 so as to intersect the nick. Thus, the intersection point P would be located nearer the top edge 24*a* in such an embodiment.

Referring back to FIG. 3*a*, a second cut score 76 is formed in the minor flap 24. The second cut score 76 extends from or near the intersection point P into a general middle area or interior of the minor flap 24. The second cut score 76 also extends slightly downwardly toward the bottom wall 12. More specifically, the second cut score 76 intersects with the knife cut 74 and the first cut score 72 at intersection point P. The second cut score 76 is shown in FIG. 3*a* as being in a general shape of an inverted portion of the letter "J". This J-cut configuration assists in forming the web comer of the tray. The second cut score 76 is formed from the inner surface of the blank 40 and, thus, is hidden in FIG. 3*b*. The second cut score 76 may be referred to as an inside cut score. The second cut score 76 generally extends from about 30 to about 70% into the blank and, more typically, extends from about 40 to about 60% into the blank 40.

It is contemplated that the first cut score 72 may be formed from the inner surface of the blank 40 instead of being formed from the outer surface of the blank 40. If the first cut score 72 is formed from the inner surface of the blank 40, then the second cut score 76 must be formed from the outer surface of the blank 40. Thus, the first cut score 72 and the second cut score 76 must always be formed from opposing surfaces of the blank 40.

Figure 4:
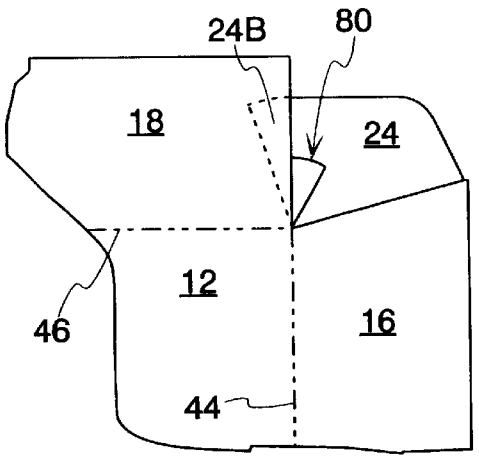
FIGS. 4 and 5 are enlarged plan views showing the sequence of folding the minor flap of FIG. 3 to form a corner of the tray.
Figure 5:
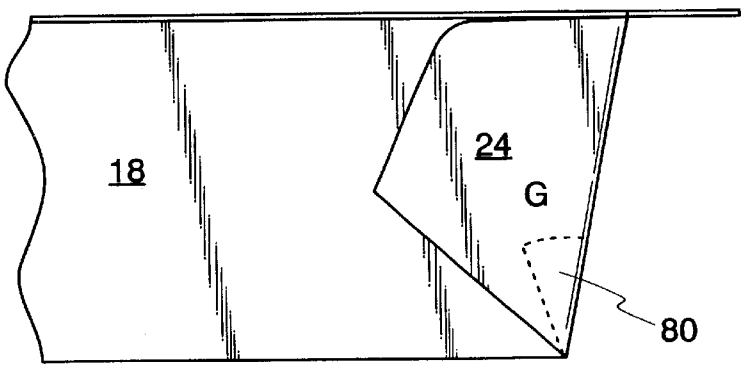

FIGS. 4 and 5 depict steps of one folding process of the minor flap 24 to form a webbed corner of the tray 10. FIG. 4 depicts the inner surface of a portion of the blank 40, while FIG. 5 depicts an outer surface of a portion of the blank 40 after forming the tray 10. The sidewall 18 is folded upwardly from the bottom wall 12 via the fold line 46. During the upward folding of the sidewall 18, the cut scores 72 and 76 (see FIGS. 3*a* and 3*b*) assist in delaminating a web-like portion 80. As depicted in FIG. 4, the web-like portion 80 is located in a lower corner of the minor flap 24. At about the same time, a portion of the minor flap 24*b* begins to fold behind an outer surface of the sidewall 18. The other sidewalls (including sidewall 16 shown in FIG. 4) also are folded upwardly from the bottom wall 12.

As shown in FIG. 5, the minor flap 24 continues to fold behind the outer surface of the sidewall 18. The inner surface of the minor flap 24 may be adhered to the outer surface of the sidewall 18 via an adhesive in a general area G. The web-like portion 80 is located between the outer surface of sidewall 18 and the remainder of the minor flap 24. Similar web-like portions (not shown) are preferably formed on all of the corners of the tray 10.

The configuration of the minor flap 24, including the web-like portion 80, inhibits or prevents food and/or liquid from escaping through the corners of the tray 10. The present invention also provides improved processing conditions as compared with full-web corner trays. One example of an improved processing condition is the reduction of glue bonds needed in the present invention as compared to full-web corner trays (typically two glue bonds). Furthermore, the comer build-up of the present invention has been reduced substantially from a full-web comer tray which assists in stacking of the trays.

Alternatively, if the second cut score 76 is formed from the outer surface of the minor flap 24 and the first cut score 72 is formed from the inner surface of the blank 40, then the folding process (not shown) is different than that described above in conjunction with FIGS. 4 and 5. The folding process to form a tray of such an embodiment would result in the minor flap 24 being folded and preferably adhered to an inner surface of the sidewall 18.

Alternatively, the corners of the tray may be formed by locking the minor flaps to respective sidewalls (not shown) instead of using adhesives. This locking may occur through the use of stripper locks (also referred to as kliklocks).

Figure 6B:
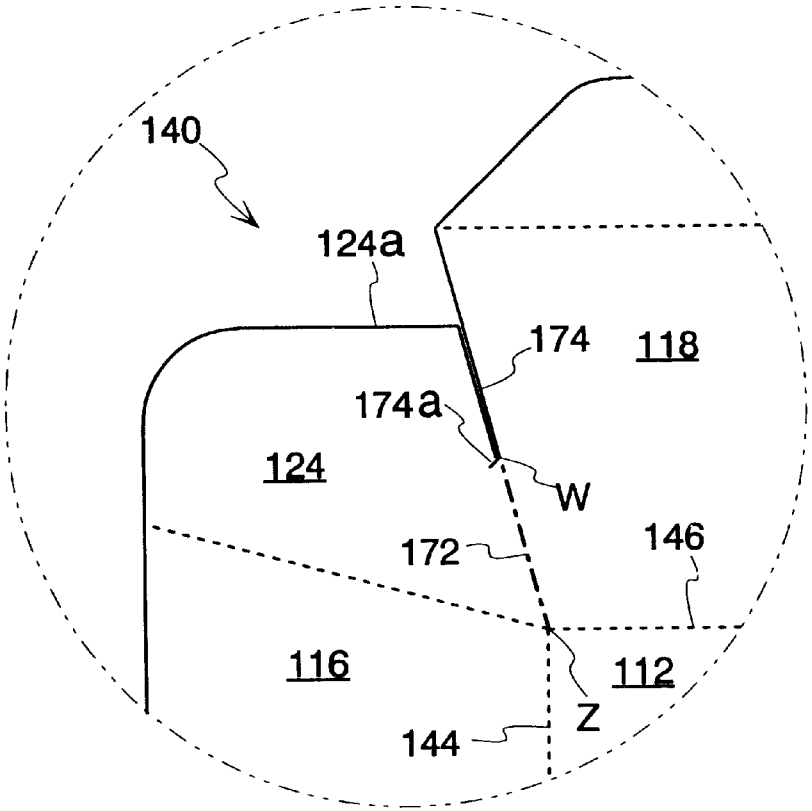
FIG. 6*b* is an enlarged plan view FIG. 6*a* shown from an outer surface of the minor flap.
Figure 6A:
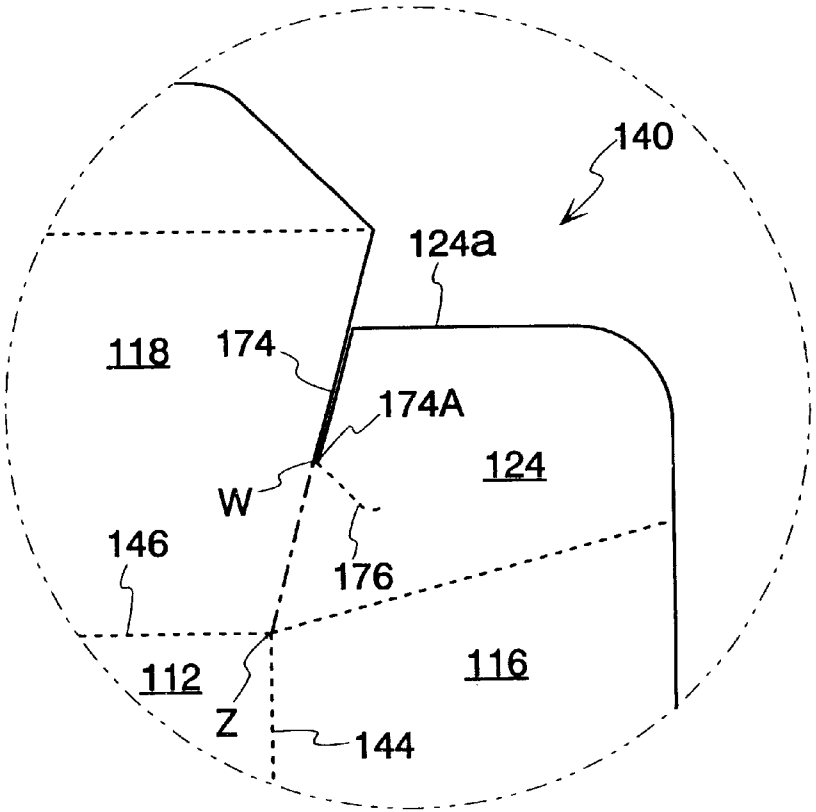
FIG. 6*a* is an enlarged plan view of an inner surface of a minor flap according to another embodiment.

According to another embodiment of the present invention, a portion of a blank 140 for forming a tray is shown in FIGS. 6*a* and *b*. The blank 140 is similar to that described above in the blank 40. One difference between the blank 140 and the blank 40 is that a knife cut 174 that separates a sidewall panel 118 and a minor flap 124 is formed slightly into the minor flap 124 at portion 174*a*. The portion 174*a* extends downward toward a bottom wall panel 112. The bottom wall panel 112 is separated from sidewall panels 1 16 and 118 via respective fold lines 144 and 146.

Because the knife cut 174 is formed into the minor flap 124, a second cut score 176 (see FIG. 6*a*) does not intersect with the knife cut 174 at point W. A first cut score 172 (see FIG. 6*b*), however, extends to or near point W. Specifically, the first cut score extends from the intersection point Z of the bottom wall panel 112, sidewall panels 116 and 118 and the minor flap 124. It is preferred that the first cut score 172 extends to and intersects the knife cut 174 at point W. It is contemplated that point W may be closer or further from a top edge 124*a* of the minor flap. It is also preferred that the second cut score 176 extends to and intersects portion 174*a*. The portion 174*a* should be of a length that makes for an easy formation of a web portion. The portion 174*a* is preferably from about 1/32 to about 1/16 of an inch in length. One advantage of this embodiment is the absence of any intersection points that are associated with more than two blades or knives.

The trays of the present invention can hold a variety of items, but are typically used to hold food and/or liquid products. Examples of food and/or liquid products include chicken, turkey, ribs, pasta, lasagna, stew, cornish hens and pot roast.

The tray of the present invention may be made from a variety of materials, but are typically made from paperboard or a film-coated paperboard. The thicknesses of the trays are generally from about 0.014 to about 0.026 inches. To enhance the aesthetic appearance and marketing appeal of the tray 10, the sidewalls may be intaglioed with an attractive design.

The height and shape of the trays may vary from that shown without departing from the scope of the invention. Many variety of trays are contemplated with the present invention including tapered trays, straight side-wall trays, Brightwood trays, Beers trays or stripper lock trays (Kliklock).

Figure 7:
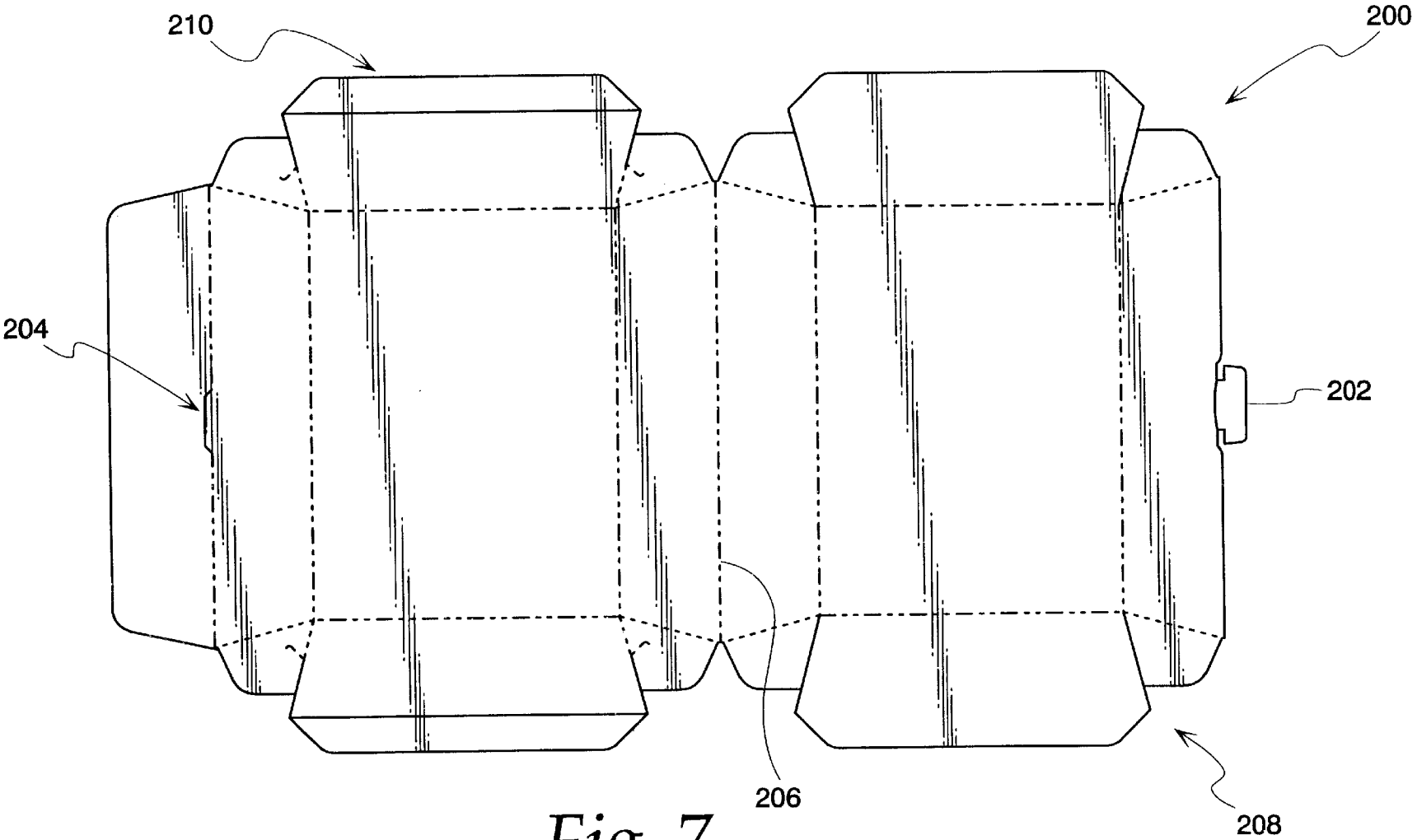
FIG. 7 is a plan view of an inner surface of a unitary, continuous blank used to form a clamshell tray.

The trays may also be used in conjunction with a lid to form a container such as a clamshell container. One example of a blank 200 to form a clamshell container is shown in FIG. 7. The blank 200 includes a fastener arrangement that includes a tab 202 and a corresponding opening 204. Other fastener arrangements are contemplated other than depicted in FIG. 7. The clamshell container is formed by use of a hinge 206 located between a tray portion 208 and a top portion 210.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A tray composed of a unitary, continuous blank having an inner surface and an outer surface, the tray comprising a bottom wall, a plurality of sidewalls extending upwardly from the bottom wall and a plurality of minor flaps, each of the plurality of minor flaps being connected to one of the plurality of sidewalls via a fold line and having a respective outer edge, at least one of the plurality of minor flaps being connected to one of the plurality of sidewalls via a first cut score, the first cut score extending upwardly from the bottom wall without extending to the outer edge of the at least one of the plurality of minor flaps, the at least one of the plurality of minor flaps having means to separate from the one of the plurality of sidewalls, the separation means extending from near the outer edge of the at least one of the plurality of minor flaps downward toward and near the first cut score, the at least one of the plurality of minor flaps having a second cut score formed therein, the second cut score extending from near the separation means, the first and second cut scores being formed from opposing surfaces of the blank so as to form a partial web.

2. The tray of claim 1, wherein the first cut score is located on an inner surface of the tray and the second cut score is located on an outer surface of the tray.

3. The tray of claim 1, wherein the first cut score is located on an outer surface of the tray and the second cut score is located on an inner surface of the tray.

4. The tray of claim 1, wherein the separation means is a knife cut.

5. The tray of claim 1, wherein the separation means is a nick.

6. The tray of claim 1, wherein the blank comprises paperboard.

7. The tray of claim 1, wherein the first cut score, the separation means and the second cut score intersect at one point.

8. The tray of claim 1, wherein the first cut score intersects the separation means and the separation means extends from the outer edge of the at least one of the plurality of minor flaps.

9. The tray of claim 1, wherein the second cut score is formed by a J-cut.

10. The tray of claim 1, wherein the separation means further extends into the at least one of the plurality of minor flaps.

11. The tray of claim 10, wherein the second cut score intersects with the separation means in the at least one of the plurality of minor flaps.

12. The tray of claim 11, wherein the first cut score intersects the separation means and the separation means extends from the outer edge of the at least one of the plurality of minor flaps.

13. The tray of claim 1, wherein all of the plurality of minor flaps have a respective first cut score, a respective separation means and a respective second cut score.

14. A tray composed of a unitary, continuous blank having an inner surface and an outer surface, the tray comprising a bottom wall, a plurality of sidewalls extending upwardly from the bottom wall and a plurality of minor flaps, each of the plurality of minor flaps being connected to one of the plurality of sidewalls via a fold line and having a respective outer edge, at least one of the plurality of minor flaps being connected to one of the plurality of sidewalls via a first cut score, the first cut score extending upwardly from the bottom wall without extending to the outer edge of the at least one of the plurality of the minor flaps, the at least one of the plurality of minor flaps being separated from the one of the plurality of sidewalls via a knife cut, the knife cut extending from near the outer edge of the at least one of the plurality of the minor flaps downward toward and near the first cut score, the at least one of the plurality of minor flaps having a second cut score formed therein, the second cut score extending from near the knife cut, the first and second cut scores being formed from opposing surfaces of the blank so as to form a partial web.

15. The tray of claim 14, wherein the first cut score is located on an inner surface of the tray and the second cut score is located on an outer surface of the tray.

16. The tray of claim 14, wherein the first cut score is located on an outer surface of the tray and the second cut score is located on an inner surface of the tray.

17. The tray of claim 14, wherein the blank comprises paperboard.

18. The tray of claim 14, wherein the first cut score intersects the knife cut and the second cut score intersects the knife cut.

19. The tray of claim 18, wherein the knife cut extends from an outer edge of the at least one of the plurality of the minor flaps.

20. The tray of claim 14, wherein the knife cut further extends into the at least one of the plurality of the minor flaps.

21. The tray of claim 14, wherein all of the plurality of minor flaps have a respective first cut score, a respective knife cut and a respective second cut score.

22. A unitary, continuous blank for forming a container, the blank having an inner surface and an outer surface, and comprising a bottom wall panel, a plurality of sidewall panels and a plurality of minor flaps, each of the plurality of minor flaps being connected to one of the plurality of sidewall panels via a respective fold line and having a respective outer edge, at least one of the minor flaps being connected to one of the plurality of sidewall panels via a first cut score, the first cut score extending from the bottom wall panel without extending to the outer edge of the at least one of the plurality of the minor flaps, the at least one of the plurality of minor flaps having means to separate from one of the plurality of sidewall panels, the separation means extending from near the outer edge of the at least one of the plurality of the minor flaps toward and near the first cut score, the at least one of the plurality of minor flaps having a second cut score formed therein, the second cut score extending from near the separation means, the first and second cut scores being formed from opposing surfaces of the blank and adapted to form a partial web.

23. The blank of claim 22, wherein the blank comprises paperboard.

24. The blank of claim 22, wherein the first cut score, the separation means and the second cut score intersect at one point.

25. The blank of claim 22, wherein the first cut score intersects the separation means and the separation means extends from an outer edge of the at least one of the plurality of the minor flaps.

26. The blank of claim 22, wherein the separation means further extends into the at least one of the plurality of the minor flaps.

27. The blank of claim 22, wherein the second cut score intersects with the separation means in the at least one of the plurality of the minor flaps.

28. The blank of claim 22, wherein all of the plurality of minor flaps have a respective first cut score, a respective separation means and a respective second cut score.

29. A unitary, continuous blank for forming a container, the blank having an inner surface and an outer surface, and comprising a bottom wall panel, a plurality of sidewall panels and a plurality of minor flaps, each of the plurality of minor flaps being connected to one of the plurality of sidewall panels via a respective fold line and having a respective outer edge, at least one of the plurality of minor flaps being connected to one of the plurality of sidewall panels via a first cut score, the first cut score extending from the bottom wall panel without extending to the outer edge of the at least one of the plurality of the minor flaps, the at least one of the plurality of minor flaps being separated from the one of the plurality of sidewall panels via a knife cut, the knife cut extending from near the outer edge of the at least one of the plurality of the minor flaps toward and near the first cut score, the at least one of the plurality of minor flaps having a second cut score formed therein, the second cut score extending from near the knife cut, the first and second cut scores being formed from opposing surfaces of the blank and adapted to form a partial web.

30. The blank of claim 29, wherein the blank comprises paperboard.

31. The blank of claim 29, wherein the first cut score, the knife cut and the second cut score intersect at one point.

32. The blank of claim 29, wherein the first cut score intersects the knife cut and extends from an outer edge of the at least one of the plurality of the minor flaps.

33. The blank of claim 29, wherein the knife cut further extends into the at least one of the plurality of the minor flaps.

34. The blank of claim 29, wherein all of the plurality of minor flaps have a respective first cut score, a respective knife cut and a respective second cut score.

35. A process of forming a container composed of a unitary, continuous blank comprising:

providing the blank having an inner surface and an outer surface, the blank comprising a bottom wall panel, a plurality of sidewall panels and a plurality of minor flaps, each of the plurality of sidewall panels being connected to the bottom wall panel via respective fold lines, each of the plurality of minor flaps being connected to one of the plurality of sidewall panels via a fold line and having a respective outer edge, each of the plurality of minor flaps being connected to a respective one of the plurality of sidewall panels via a respective first cut score, each of the first cut scores extending from the bottom wall panel without extending to the outer edge of the respective ones of the plurality of minor flaps, each of the plurality of minor flaps having means to separate from the respective one of the plurality of sidewall panels, each of the separation means extending from near the outer edge of the respective ones of the plurality of minor flaps toward and near the first cut score, each of the plurality of minor flaps having a second cut score formed therein, each of the second cut scores extending from near the respective separation means, each of the first and second cut scores being formed from opposing surfaces of the blank and adapted to form a respective partial web;

folding the plurality of sidewall panels upwardly from the bottom wall panel via the respective fold lines; and folding and securing each of the plurality of minor flaps to the respective one of the plurality of sidewall panels that each of the plurality of the minor flaps is connected thereto via the respective first cut scores such that the respective partial webs are formed from the respective first and second cut scores.

36. The process of claim 35, wherein the provided blank has the first cut scores located on an inner surface of the blank and the second cut scores are located on an outer surface of the blank, and wherein the folding and securing of each of the plurality of minor flaps is to an outer surface of the respective one of the plurality of sidewall panels.

37. The process of claim 36, wherein the plurality of the minor flaps are secured to the outer surface of the respective one of the plurality of sidewall panels via an adhesive.

38. The process of claim 35, wherein the provided blank has the first cut scores located on an outer surface of the blank and the second cut scores are located on an inner surface of the blank, and wherein the folding and securing of each of the plurality of minor flaps is to an inner surface of the respective one of the plurality of sidewall panels.

39. The process of claim 38, wherein the plurality of minor flaps are secured to the inner surface of the respective one of the plurality of sidewall panels via an adhesive.

40. The process of claim 35, wherein the separation means is a knife cut.

* * * * *